US006062205A

United States Patent [19]

Bevan et al.

[11] Patent Number: 6,062,205

[45] Date of Patent: May 16, 2000

[54] VALVE ASSEMBLIES

[75] Inventors: Neil Bevan, Water Orton; Geoffrey Ralph Mosby, Sutton Coldfield, both of United Kingdom

[73] Assignee: Lucas Industries plc, United Kingdom

[21] Appl. No.: 09/102,445

[22] Filed: Jun. 22, 1998

[30] Foreign Application Priority Data

Jun. 25, 1997 [GB] United Kingdom ..... 9713346

[51] Int. Cl.[7] ..... F02M 25/07

[52] U.S. Cl. ..... 123/568.24

[58] Field of Search ..... 123/568.11, 568.17, 123/568.18, 568.23, 568.24

[56] References Cited

U.S. PATENT DOCUMENTS

| | | | |
|---|---|---|---|
| 4,304,207 | 12/1981 | Aihara et al. | 123/568.24 |
| 4,475,524 | 10/1984 | Eckert et al. | 123/568.23 |
| 4,924,840 | 5/1990 | Wade | 123/568.24 |
| 5,531,205 | 7/1996 | Cook et al. | 123/568.24 |
| 5,562,085 | 10/1996 | Kosuda et al. | 123/568.24 |
| 5,746,190 | 5/1998 | Honda | 123/568.18 |

FOREIGN PATENT DOCUMENTS

| | | |
|---|---|---|
| 2 724 976 | 3/1996 | France . |
| 35 11 094 | 10/1986 | Germany . |
| 196 33 603 | 11/1997 | Germany . |

*Primary Examiner*—Willis R. Wolfe

*Attorney, Agent, or Firm*—Andrus, Sceales, Starke & Sawall

[57] ABSTRACT

An exhaust gas recirculation valve assembly for an internal combustion engine comprising a passage communicating in use with the exhaust of the internal combustion engine and a rotary valve in said passage controlling flow of exhaust gases through said passage to mix in use with the inlet charge of the engine.

8 Claims, 4 Drawing Sheets

VALVE ASSEMBLIES

This invention relates to an exhaust gas recirculation (EGR) valve assembly for use with an internal combustion engine, primarily, but not exclusively a diesel engine.

The concept of recirculating a controlled variable proportion of the exhaust gases into the inlet charge of the engine to minimise the production of certain exhaust pollutants, for example oxides of nitrogen, is well known. The use of a valve member moved rectilinearly by a solenoid actuator has previously been proposed.

In accordance with the present invention there is provided an exhaust gas recirculation valve assembly for an internal combustion engine comprising a passage communicating in use with the exhaust of the internal combustion engine and a rotary valve in said passage controlling flow of exhaust gases through said passage to mix in use with the inlet charge of the engine.

Preferably said rotary valve includes an angularly moveable valve member and a rotary actuator for moving said valve member, the axis about which said valve member is moved by said actuator extending substantially perpendicular to the direction of gas flow in said passage.

Desirably said passage is defined by a housing also defining a second passage through which engine inlet gas flows in use, the first passage merging with said second passage downstream of said rotary valve.

Desirably said angularly moveable valve member comprises a generally circular cylindrical spool member rotatably received in a correspondingly cylindrical seating disposed in said housing and intersecting said first passage substantially at right angles thereto, said spool member being shaped in relation to its seating such that in a first angular position of the spool member relative to the seating the valve is closed, while in a second angular position of the spool member relative to the seating gas can flow from the first passage through the valve member to the second passage.

Preferably said second passage comprises first and second angularly disposed passage portions interconnected by a bend, and said first passage intersects said second passage in the apical region of the bend adjacent the inside wall of the bend.

Preferably said first and second portions of the second passage are disposed at 90° to one another and said first passage extends at 45° to both of said first and second portions of the second passage, the first and second portions of the second passage and the first passage having their axes lying in a common plane.

Preferably the axis of movement of the valve member is perpendicular to said common plane.

Preferably the shaping of said spool member is such that when the valve is open there is gas flow between the spool member and its seating on both sides of the axis of the spool member, and the shaping of the spool member is such that as the valve opens the torque effects acting on the spool member on both sides of its axis as a result of gas flow over the spool member are substantially balanced so that resultant torque on the spool member arising from the gas flow is substantially zero.

Preferably the valve actuator lies in the flow path of said inlet charge.

One example of the invention is illustrated in the accompanying drawings, wherein:

FIG. 6 is a transverse cross-sectional view of the assembly shown in

Figure 1:
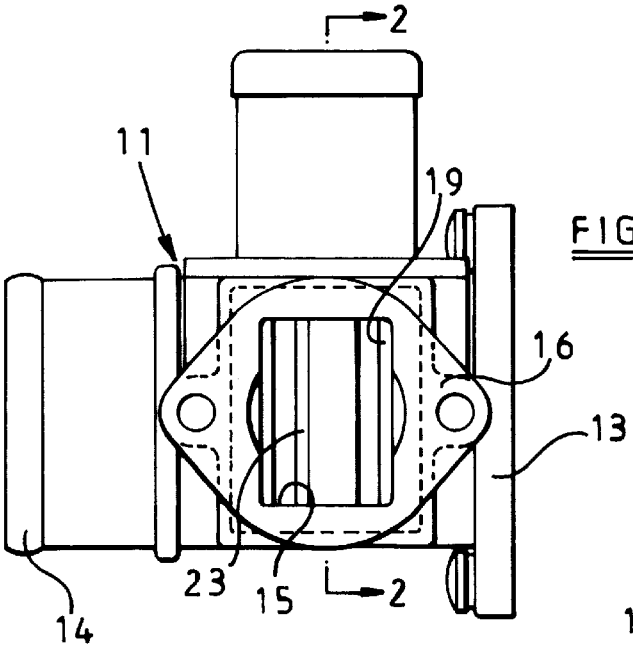
FIG. 1 is a side elevational view of an exhaust gas recirculation valve assembly in accordance with a first example of the present invention.
Figure 4:
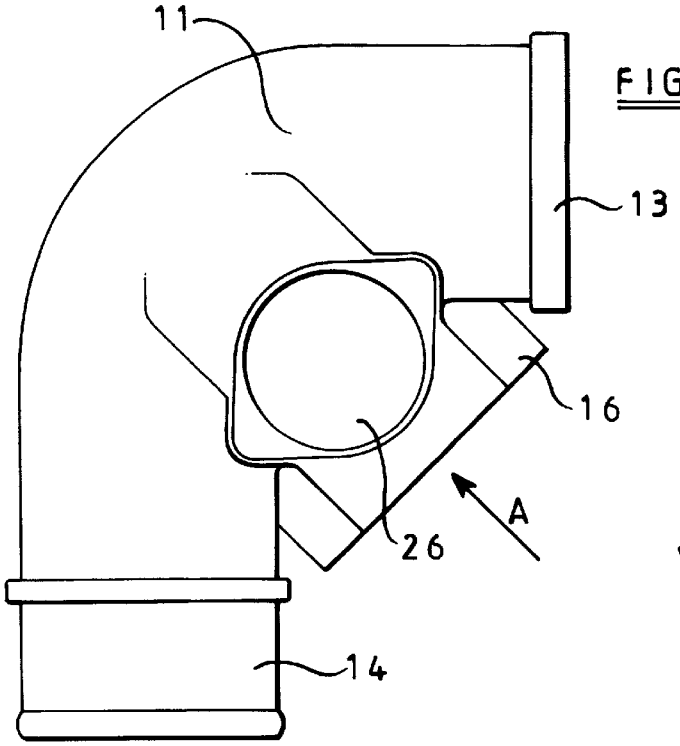
FIG. 4 is a diagrammatic plan view of an EGR valve assembly in accordance with a second example of the present invention.
Figure 5:
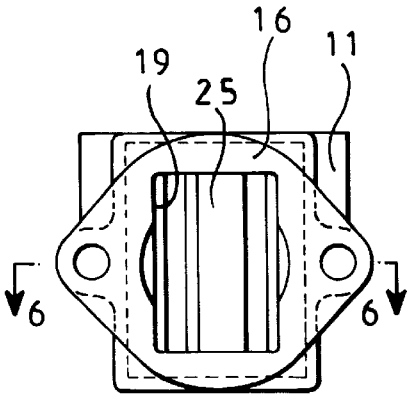
FIG. 5 is a view in the direction of arrow "A" in FIG. 4.
Figure 6:
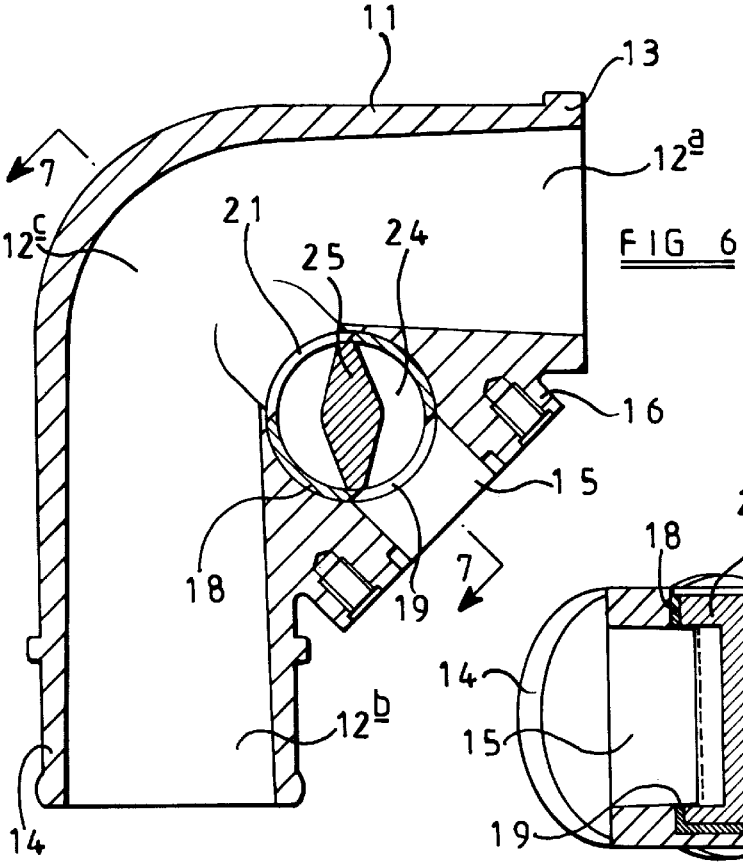
Figure 7:
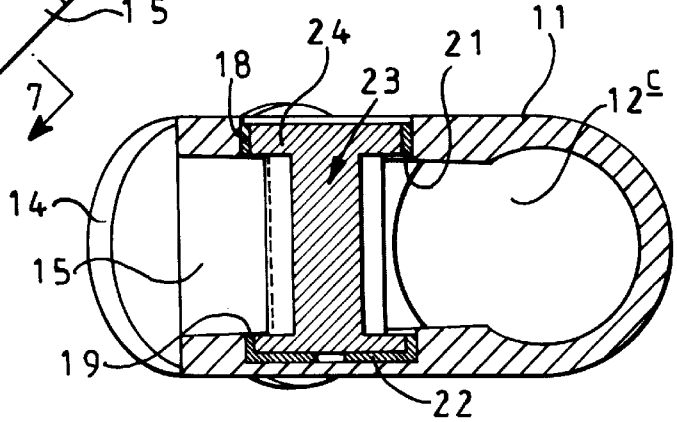
Figure 8:
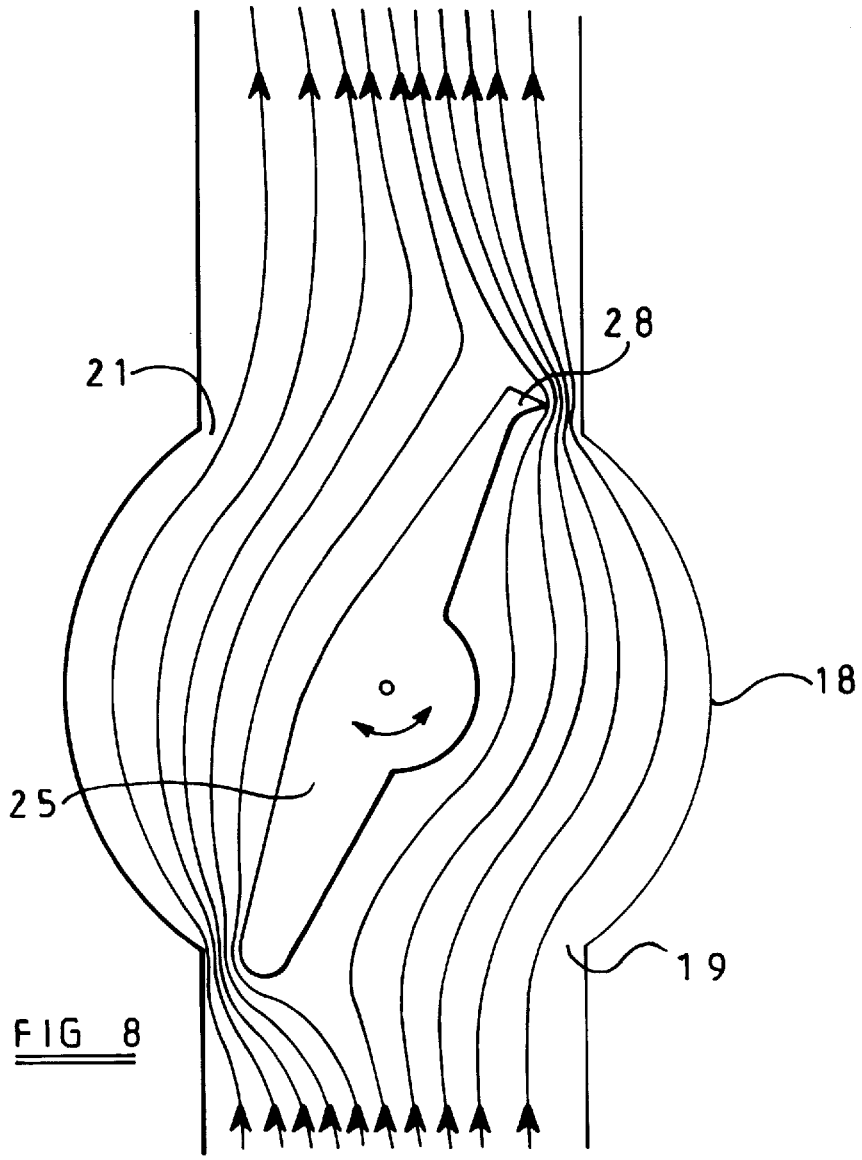
Figure 9:
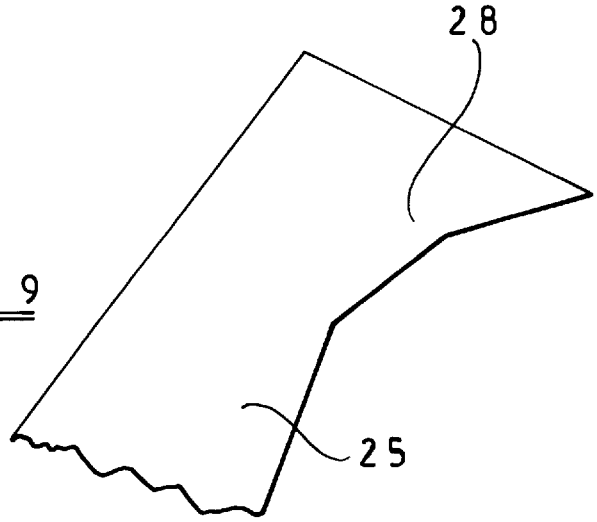
Figure 10:
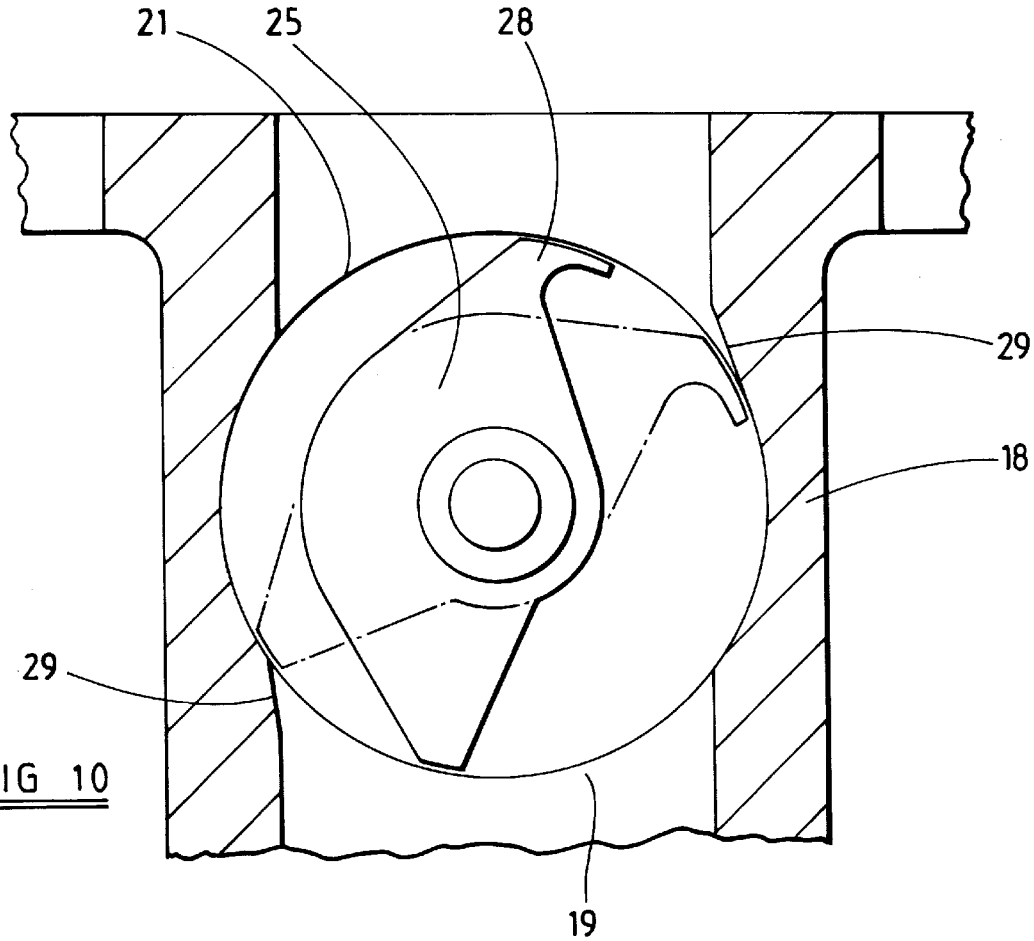
Figure 11:
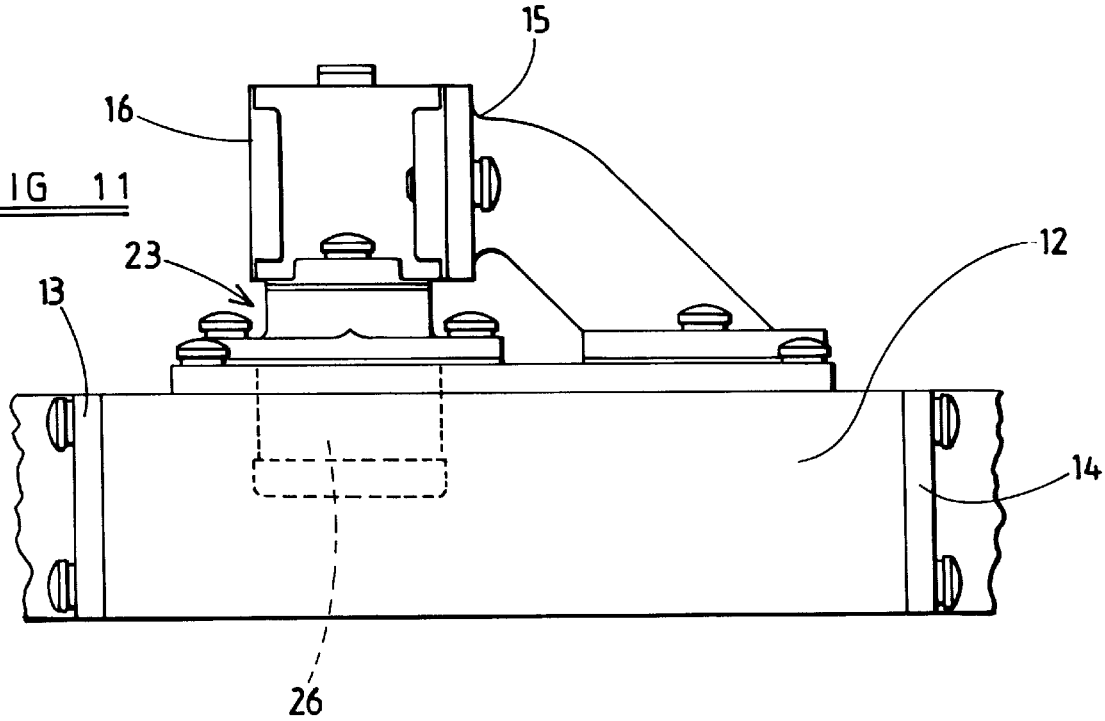

FIG. 4, the cross-section being on the line 6—6 in FIG. 5;

FIG. 7 is a cross-sectional view on the line 7—7 in FIG. 6;

FIG. 8 is a diagrammatic representation of the valve member of an EGR valve assembly in accordance with a third example of the invention, illustrating gas flow through the valve;

FIG. 9 is an enlargement of part of FIG. 8;

FIG. 10 is a view similar to FIG. 8 of a modification, and,

FIG. 11 is a view similar to FIG. 1 of an EGR valve assembly in accordance with a third example of the present invention.

Figure 2:
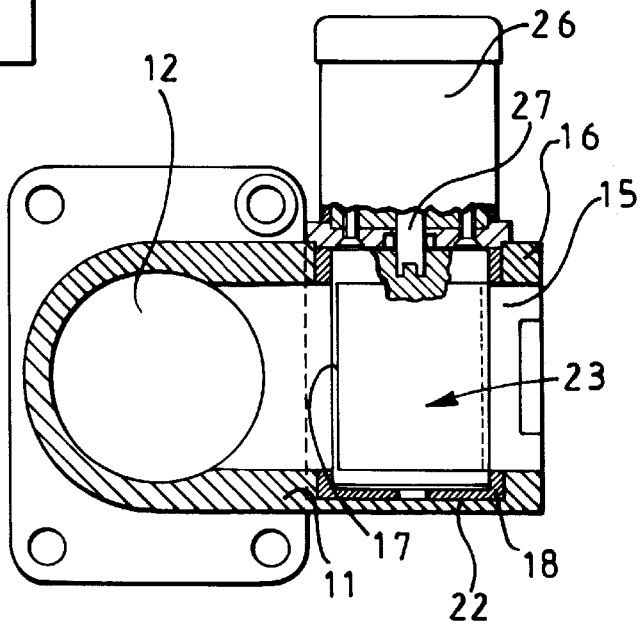
FIG. 2 is a sectional view on the line 2—2 in FIG. 1.
Figure 3:
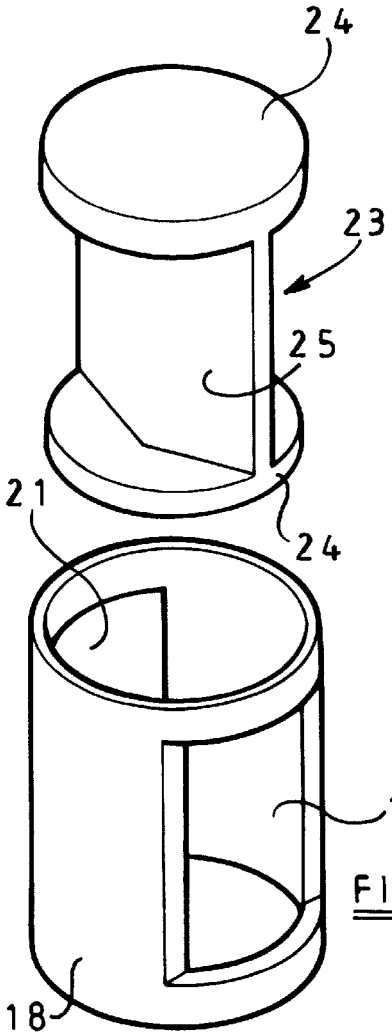
FIG. 3 is a diagrammatic representation of the rotary valve member of the EGR valve assembly of FIGS. 1 and 2.

Referring first to FIGS. 1, 2 and 3 of the accompanying drawings the exhaust gas recirculation valve assembly comprises a cast metal housing 11 defining internally a passage 12 of circular cross-section extending from a first inlet flange 13 of the housing 1 to an outlet union 14 of the housing 11. The passage 12 is rectilinear, and in use carries a flow of inlet charge, conventionally ambient air, to the associated internal combustion engine.

The housing 11 also defines a second passage 15 extending at right angles to and intersecting the passage 12, the housing defining a second inlet flange 16. Within the housing 11 the passage 15, intermediate the flange 16 and the passage 12, defines a valve chamber 17. A valve mechanism is housed within the chamber 17 and comprises a circular cylindrical seating 18 in the form of a metal sleeve of circular cross-section open at both axial ends, and having first and second diametrically opposed rectangular windows 19, 21 formed in its wall. The seating 18 is received in the chamber 17 such that its longitudinal axis is disposed perpendicular to and intersecting the longitudinal axis of the passage 15, the windows 19, 21 being aligned with the passage 15. A bearing disc 22, shown in FIG. 2 as integral with the seating 18, but formed as a separate component if desired, closes the lower end of the seating 18.

Rotatably disposed in the seating 18 is a valve closure member 23 in the form of a metal spool consisting of upper and lower circular, coaxial discs 24 of the same diameter integrally interconnected by a web 25 of width equal to the diameter of the discs 24 but of much smaller thickness. The diameter of the discs 24 matches the internal diameter of the seating 18 so that the closure member 23 is a close, but rotatable fit in the seating 18. The cylindrical surfaces of the discs 24 and the edge surfaces of the web 25 form a sliding, sealing fit with the interior of the seating 18. It will be recognised therefore that when the edges of the web 25 engage the seating 18 between the windows 19, 21 the valve is in a closed position since the web 25 prevents flow through the seating 18. However, rotation of the member 23 to a position in which the edges of the web 25 overlie the windows 19, 21 respectively, opens the valve so that flow can take place from the exhaust manifold through the passage 15, on both sides of the web 25, and into the passage 12.

The housing 11 is arranged, above the passage 15, to define a mounting boss for receiving and securing a rotary actuator 26 the output shaft 27 of which is engaged with the closure member 23 such that operation of the actuator 26 rotates the closure member 23 within the seating 18. The rotary actuator 26 can take a number of forms, but conveniently is an electrical stepper motor or torque motor, energization of which is controlled to control the degree of opening of the valve, by controlling the rotated position of the member 23, such that controlled recirculation of exhaust gases into the inlet charge flowing in the passage 12 can be achieved.

FIGS. 4 to 7 illustrate an EGR valve assembly in accordance with a second example of the present invention. The primary distinguishing feature over the embodiment illustrated in FIG. 1 to 3 is that the housing 11 is shaped to define a 90° bend in the passage 12. Thus the passage 12 includes a rectilinear inlet portion 12*a*, a rectilinear outlet portion 12*b*, and an intermediate bend portion 12*c* in the form of a 90° circular arc. The exhaust gas inlet passage 15 has its longitudinal axis lying in a plane containing the axes of the three portions of the passage 12, and the passage 15 intersects the passage 12 at the apex of the bend portion 12*c*. The axis of the passage 15 is spaced by 45° from the axes of the passage portions 1 2*a* and 1 2*b* and thus the intersection of the passages 12 and 15 is at the inner wall of the bend of the passage 12, that is to say at the point where the radius of curvature of the passage wall is least. The remainder of the valve assembly in FIGS. 4 to 7 is as described above with reference to FIGS. 1 to 3.

The effect of positioning the intersection of the passage 15 with the passage 12 at the inside of the bend in the passage 12 is to make use of the low pressure region which exists at that point in the portion 12*c*of the passage as a result of the effect of gas flow around the portion 12*c*of the passage 12. Thus the intersection of the passages 15 and 12 at a low pressure region of the passage 12 assists the flow of exhaust gases from the passage 15 into the passage 12 by comparison with the arrangement which exists, for example, in the FIG. 1 assembly where the intersection of the passages 12 and 15 is in a rectilinear region of the passage 12.

The web 25 of the closure member 23 of the rotary valve is, as is apparent for example from FIG. 6, symmetrical about a median plane containing the axis of rotation of the member 23. It will be recognised therefore that at the point at which the valve opens, that is to say taking FIG. 6 as an example, the point at which the member 23 has moved sufficiently far in a counterclockwise direction for the front edge of the web 25 to clear the left hand side of the window 19 and the rear edge of the web 25 to clear the right hand side of the window 21, the flow through the seating 18 is divided into two streams passing respectively on opposite sides of the web 25. Substantially the whole of one face of the web is presented to one flow stream by its exposure through the window 19, and it is convenient to refer to this face as the "pressure surface" of the web. As a result of the inclination of the surface in relation to the flow direction the flow area for the gas stream passing between the pressure surface of the web 25 and the seating 18, diminishes from a maximum at the leading edge of the web adjacent the window 19 to a minimum where the trailing edge of the web clears the right hand edge of the window 21. The pressure surface will thus be subjected to a pressure distribution from high pressure at the leading edge to low pressure at the trailing edge as dictated predominantly by Bernoilli effect. The pressure distribution on the pressure surface of the web thus generates a net clockwise torque tending to close the valve.

The flow conditions at the opposite face of the web 25 (conveniently designated the suction surface) generate a relatively low torque by comparison with the conditions at the pressure surface and thus the overall result is that as the valve opens, the flow through the valve generates a torque tending to close the valve. It follows therefore that the torque necessary to open the valve is greater than the torque necessary simply to overcome friction effects between the closure member 23 and the seating 18.

FIG. 8 illustrates a design of closure member web 25 in which the net torque imposed on the closure member by flow effects is minimised. In essence, the trailing edge of the pressure surface of the web 25 is shaped to define a lip 28 extending in a clockwise direction and thus moving, relative to the axis of rotation of the closure member, the position of the surface upon which low pressure acts. The effect of this change in position, by comparison with the symmetrical web 25, is to reduce the clockwise torque on the closure member and thus in effect produce a pressure surface of the web which is more nearly "torque balanced". FIG. 9 shows an enlargement of the lip area of the web of FIG. 8, but it is to be understood that the shape illustrated in FIGS. 8 and 9 is only one of a range of shapes capable of achieving the change in the position at which the force acts on the web 25.

Although the effect of flow on the suction surface of the web 25 is not of major significance in relation to the torque imposed on the closure member by the flow through the valve, benefits can be obtained by providing a suction surface geometry which will provide consistent torque effects over the intended range of valve opening (angle of attack of web surface in relation to gas flow direction) and gas flow rates. FIG. 8 illustrates that such a shaping will be essentially an aerofoil shape thus avoiding drag, and will also be substantially symmetrical about a plane at right angles to the median plane of the web 25.

FIG. 10 illustrates a modification of the arrangement described above with reference to FIGS. 8 and 9, in which the wall of the seating 18 in those regions 29 of the windows 19, 21 which coact with the leading and trailing edges of the web 25 at opening and closing, are chamfered to provide a more gradual opening and closing action of the valve with consequential smoothing of the torque effects on the web. Valves of this type are often operated at relatively small opening angles and the chamfering of the regions 29 effects improved control of gas flow through the valve at such opening angles.

Hot exhaust gasses passing through the valve transfer heat by conduction to the actuator 26 which is cooled by exposure to the ambient atmosphere. FIG. 11 illustrates a modification of the arrangements described above in which the actuator 26 is disposed in the passage 12 so as to be cooled by the flow of ambient air in the passage. The exhaust gas passage 15 is not coplanar with the air passage 12 but communicates therewith at its downstream end remote from the valve assembly. The valve assembly lies in the passage 15 as described above to control the flow of exhaust gasses to the passage 12, but the actuator 26 extends downwardly therefrom through an aperture in the wall of the passage 12 to lie in the airflow in the passage 12. It will be recognised that the positioning of the actuator in the passage 12 can apply to an assembly in which the passage 12 is rectilinear (FIGS. 1 to 3 for example), or to an assembly in which the passage has a right-angled bend (FIGS. 4 to 7). Where the passage 12 is formed with a bend then desirably the passage 15 will communicate with the passage 12 at the bend to make us of the low pressure region if possible.

We claim:

1. An exhaust gas recirculation valve assembly for an internal combustion engine comprising a passage communicating in use with exhaust of the internal combustion engine, and a rotary valve in said passage controlling flow of exhaust gases through said passage to mix in use with the inlet charge of the engine, said passage being defined by a housing which defines also a second passage through which engine inlet gas flows in use, said second passage comprising first and second angularly disposed passage portions interconnected by a bend, and said first passage intersecting said second passage in the apical region of the bend adjacent the inside wall of the bend, and downstream of said rotary valve.

2. An exhaust gas recirculation valve assembly as claimed in claim 1, wherein said first and second portions of the second passage are disposed at 90° to one another and said first passage extends at 45° to both of said first and second portions of the second passage, the first and second portions of the second passage and the first passage having their axes lying in a common plane.

3. An exhaust gas recirculation valve assembly as claimed in claim 2, wherein the axis of movement of the valve member is perpendicular to said common plane.

4. An exhaust gas recirculation valve assembly as claimed in claim 1, wherein said rotary valve includes an angularly moveable valve member and a rotary actuator for moving said valve member, the axis about which said valve member is moved by said actuator extending substantially perpendicular to the direction of gas flow in said passage.

5. An exhaust gas recirculation valve assembly as claimed in claim 4, wherein the valve actuator lies in the flow path of said inlet charge.

6. An exhaust gas recirculation valve assembly as claimed in claim 1, wherein said angularly moveable valve member comprises a generally circular cylindrical spool member rotatably received in a correspondingly cylindrical seating disposed in said housing and intersecting said first passage substantially at right angles thereto, said spool member being shaped in relation to its seating such that in a first angular position of the spool member relative to the seating the valve is closed, while in a second angular position of the spool member relative to the seating gas can flow from the first passage through the valve member to the second passage.

7. An exhaust gas recirculation valve assembly as claimed in claim 6, wherein the shaping of said spool member is such that when the valve is open there is gas flow between the spool member and its seating on both sides of the axis of the spool member, and the shaping of the spool member is such that as the valve opens the torque effects acting on the spool member on both sides of its axis as a result of gas flow over the spool member are substantially balanced so that resultant torque on the spool member arising from the gas flow is substantially zero.

8. An exhaust gas recirculation valve assembly as claimed in claim 6, wherein those regions of said seating which coact with leading and trailing edges of the spool member at the point of movement of the spool member at which opening/closing of the valve takes place, are chamfered to provide a gradual opening and closing action.

* * * * *